United States Patent [19]

Whitehill et al.

[11] 4,227,867

[45] Oct. 14, 1980

[54] GLOBOID-WORM COMPRESSOR WITH SINGLE PIECE HOUSING

[75] Inventors: Cassius F. Whitehill, Hudson, Ohio; Robert D. Whitehill, Franklin, Pa.; Ghanshyam C. Patel, Solon, Ohio

[73] Assignee: Chicago Pneumatic Tool Company, New York, N.Y.

[21] Appl. No.: 883,518

[22] Filed: Mar. 6, 1978

[51] Int. Cl.[3] ..... F04C 18/20; F04C 19/02

[52] U.S. Cl. ..... 418/97; 418/195; 418/196

[58] Field of Search ..... 418/97, 98, 195, 196; 29/156.4 R

[56] References Cited

U.S. PATENT DOCUMENTS

| | | | |
|---|---|---|---|
| 1,164,276 | 12/1915 | Fogarty | 418/195 |
| 3,182,600 | 5/1965 | Guinard | 418/195 |
| 3,632,239 | 1/1972 | Zimmern | 418/195 |
| 3,752,606 | 8/1973 | Zimmern | 418/195 |
| 3,804,564 | 4/1974 | Zimmern | 418/195 |
| 3,862,623 | 1/1975 | Ehlert | 418/195 |
| 3,902,827 | 9/1975 | Schibbye | 418/98 |
| 3,905,731 | 9/1975 | Zimmern | 418/195 |
| 4,036,567 | 7/1977 | Sato | 418/195 |

FOREIGN PATENT DOCUMENTS

| | | | |
|---|---|---|---|
| 953171 | 5/1949 | France | 418/195 |

*Primary Examiner*—John J. Vrablik

*Attorney, Agent, or Firm*—Stephen J. Rudy

[57] ABSTRACT

An air compressor of the globoid-worm type having a rotor formed with a plurality of threads in meshing relation with two oppositely arranged star pinions. The rotor and star pinions are arranged in a single piece housing which incorporates all openings as required for assemblage and operation of the functional elements of the compressor. The rotor has an integral shaft which projects from the housing. A cover encloses an end of the housing and is provided with outlet passages for the air compressed in the housing. Oil injection openings are arranged in the housing for application of lubricant to the rotor for sealing and cooling purposes.

4 Claims, 4 Drawing Figures

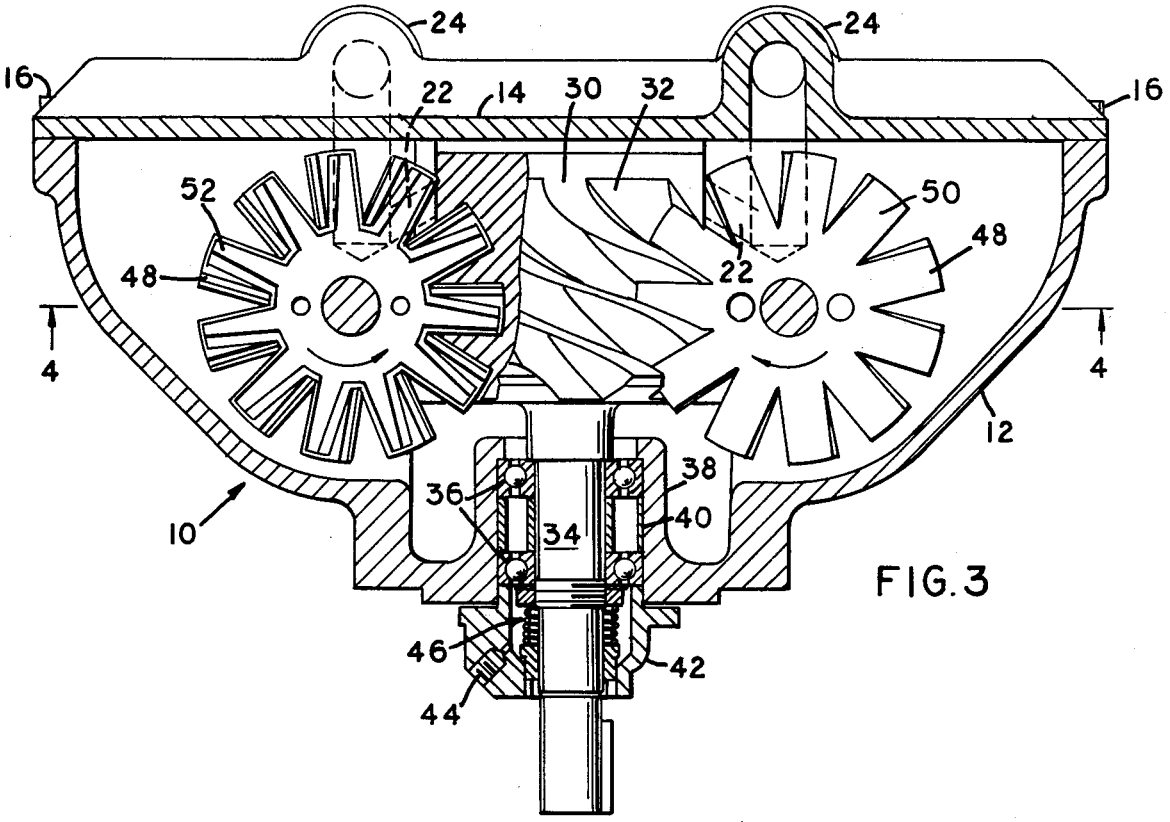
FIG. 3
FIG. 4
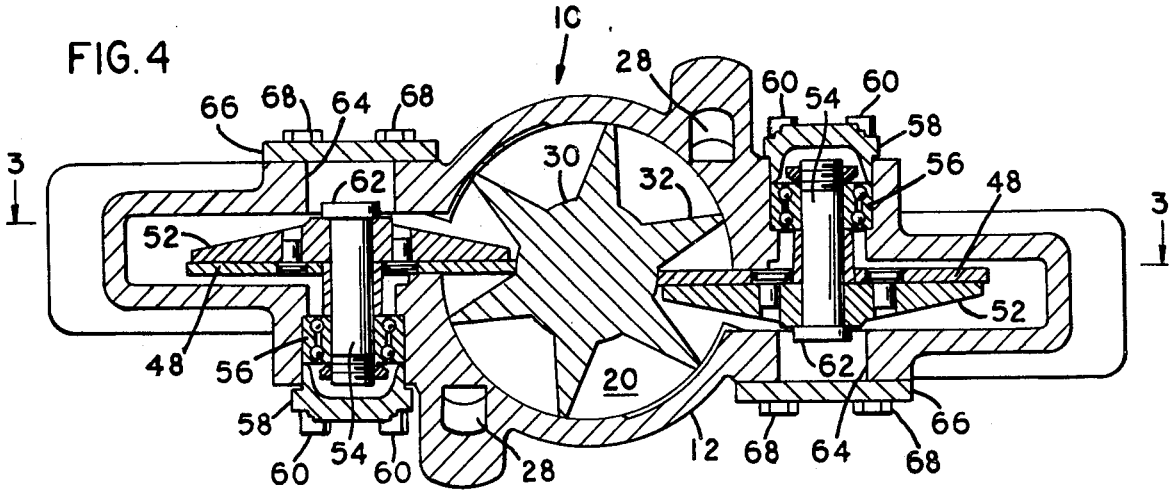

GLOBOID-WORM COMPRESSOR WITH SINGLE PIECE HOUSING

BACKGROUND OF THE INVENTION

The compressor art, namely, such machinery or devices as used to compress gases, is old and differing structural designs are known, many of which are patented.

This invention is concerned with a type of air compressor incorporating a globoid-worm having a plurality of threads in meshing relation with at least one toothed pinion, as exemplified by U.S. Pat. No. 3,945,778, Mar. 23, 1976, and U.S. Pat. No. 3,804,564, Apr. 16, 1954, both granted to Bernard Zimmern. More specifically, the subject invention represents an improvement in such Zimmern compressors insofar as manufacturing costs are reduced, efficiency is improved, and reliability is increased, all as will become evident from the detailed description of the invention set forth hereinafter.

BRIEF DESCRIPTION OF DRAWINGS

FIG. 3 is a section view as seen from line 3—3 in FIG. 4; and

FIG. 4 is a section view as seen from line 4—4 in FIG. 3.

DETAILED DESCRIPTION OF THE INVENTION

Figure 1:
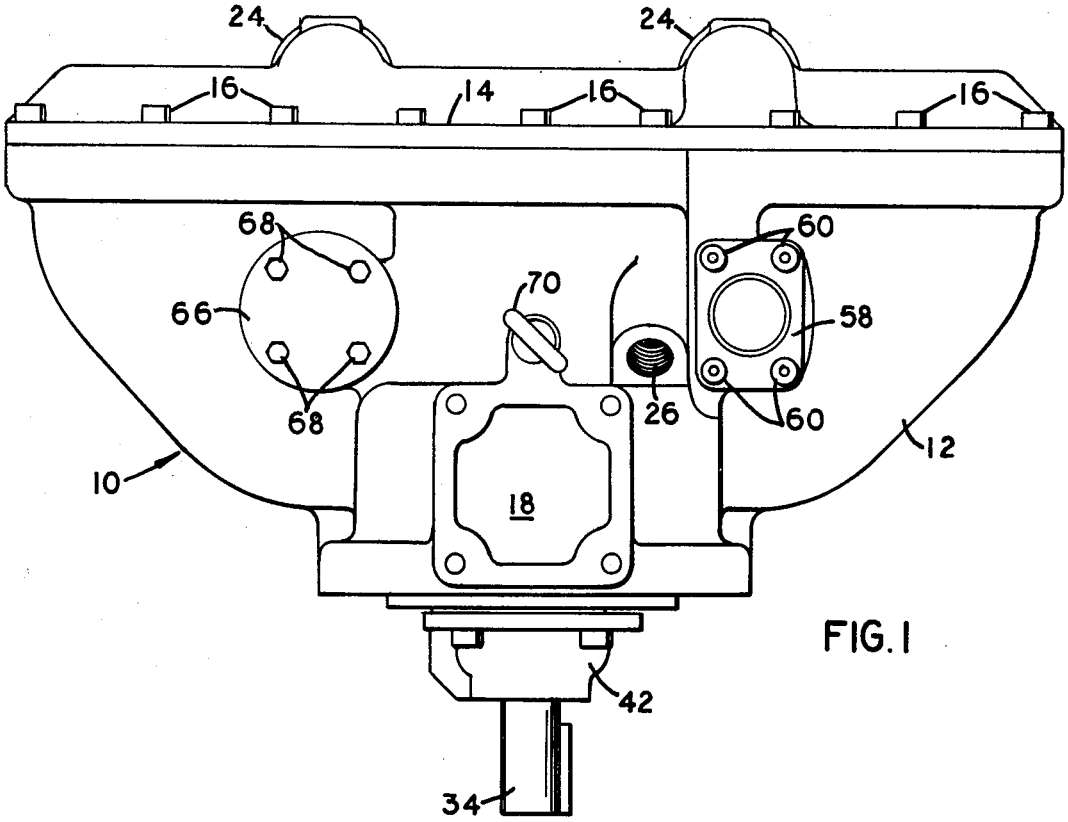
FIG. 1 is an exterior top view of a compressor incorporating the principles of the invention.
Figure 2:
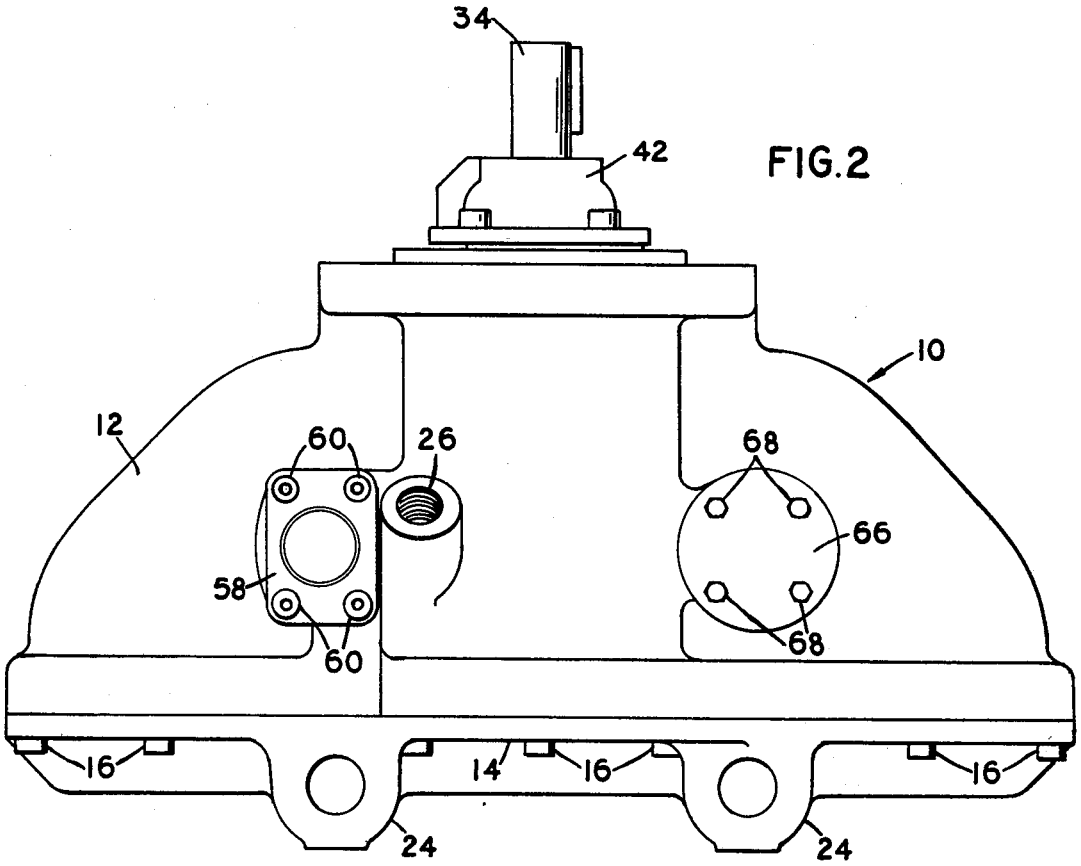
FIG. 2 is a bottom view of the compressor of FIG. 1.

Referring now to FIGS. 1 and 2 of the drawings, numeral 10 identifies an air compressor of the invention, including a housing 12 to which is removable secured a cover 14 by fastening means, such as a plurality of cap screws 16. While "air" is mentioned as the compressible medium, any compressible gas may be handled. Also, by connecting an inlet to a space to be evacuated, it will act as a vacuum pump. The housing 12, which is a unitary casting arranged to incorporate all openings as required for assemblage and operation of functional elements of the compressor, has an air inlet 18, as seen in FIG. 1. The inlet 18 opens into one end of a cylindrical chamber 20, as best seen in FIG. 4, formed in the housing 12, the other end of the chamber 20 having dual passageway means 22, each of which leads to an air outlet 24 formed in the cover 14. The housing 12 is formed with two oil injection openings 26, one on each side of the housing as seen in FIGS. 1 and 2, which connect with passageways 28 opening into the chamber 20. Oil under pressure is thus admitted to the chamber during compressor operation for sealing, cooling and lubricating purpose, as is well known in the art.

A rotor 30, having a plurality of spiral grooves 32, is arranged in the chamber 20; the rotor rotates in the chamber 20 without contacting the chamber walls. The rotor 30 is formed integral with a shaft 34 supported in a pair of bearings 36, arranged within an inwardly extending boss 38 formed in the housing 12. The shaft 34 projects from the housing for attachment to rotary power means (not shown). Spacer means 40 maintain the bearings in separated position, while allowing for flow of lubricating oil therebetween. A bonnet 42, surrounding a portion of the shaft 34 projecting from the housing, has a threaded opening 44 for receipt of an oil conduit (not shown). A spring loaded seal assembly 46 is arranged to maintain oil within the bonnet so that the bearings 36 are constantly lubricated during compressor operation.

Since the bearings 36 and seal assembly 46 are on the low pressure side of the rotor in the region of the inlet 18, they are not exposed to the high temperatures and pressures as when located at the high pressure and temperature outlet end of the rotor, as is usual with compressors of the globoid-worm type.

A pair of star pinions 48, forming roto-seals, have teeth 50 arranged to mesh with the rotor spiral grooves 32, each roto-seal being mounted upon a support 52 affixed to a shaft 54. The support 52 has teeth of equal number to teeth 50. It will be noted that each roto-seal 48 rotates in an opposite direction (FIG. 3), and the shaft 54 supporting each roto-seal is arranged in an opposite axial direction (FIG. 4). Such an arrangement not only simplifies the oil injection design, but results in identical design of the roto-seals and associated parts, which is apparent in FIG. 4. The portions of the housing enclosing the star pinions and shafts 54 are less in vertical dimension than the rotor cylindrical chamber 20, as will be evident from FIG. 4. Each shaft 54 is supported at one end by a bearing means 56 suitably mounted in the housing 12, said shaft end being enclosed by a cover 58 affixed to the housing by cap screws 60. The opposite end of each shaft 54 has an enlargement 62 which extends into an opening 64 formed in the housing and enclosed by a cover 66 secured to the housing by cap screws 68. It will be seen that the covers 58 and 66 permit easy assembly or servicing of the roto-seals and associated parts. Also, the reduction in the number of bearings used in the compressor of the subject invention, as compared to prior art compressors of such type, reduces oil churning which thereby reduces viscous drag.

The concept of making the shaft 34 integral with the rotor 30, which is not found in prior art compressors of the type being considered herein, provides certain structural advantages and leads to improvements in compressor efficiency. Among such advantages is that it simplifies machining and assembly operations since the need for critical tolerance limits, as would be required for proper fit between a separate shaft and the rotor which it supports, is avoided. It also allows the spiral grooves 32 to extend deeper into the rotor 30 without the need to contend with shaft diameter, as occurs when the shaft is not integral with the rotor. Such deeper tooth penetration allows increased compressor output as compared to the output of known compressors having the same diameter rotor as used on the compressor of the invention. If the same output is desired of the compressor of the invention, as that of said prior art compressors of the type under considerations, then the rotor diameter of the subject compressor can be decreased. Such decrease in rotor diameter reduces viscous drag which leads to an improvement in compressor efficiency. For example, a 5% reduction in rotor diameter compared to the rotor diameter of said prior art compressors, has provided a 15% to 20% reduction in viscous drag, which gave an overall improvement in efficiency.

An eyebolt 70 is secured to the housing (FIG. 1) for hoisting of the compressor.

Assemblage and operation of the compressor of the invention should be readily apparent. While the proportions and operating characteristics of the compressor embodying the invention may be varied to meet given specifications, the compressor disclosed herein could produce discharge pressures of 100 p.s.i.g. delivered in a range of 100 to 600 c.f.m., at 3550 to 2100 r.p.m., and 25 to 135 h.p. respectively.

The unique one-piece housing 12 provides savings in manufacturing and assembly costs. It also improves the reliability of the air end since the shaft seal and bearings have longer life because they operate in the cool inlet end of the compressor—not the hot discharge end. Performance of the compressor is additionally improved because of the reduction of viscous drag and improved close clearance operation due to the one-piece rotor.

We claim:

1. A gaseous medium compressor of the globoid-worm type having a cylindrical rotor formed with a plurality of threads in meshing relation with a pair of star pinions, said compressor having a single piece housing open at one end and having a large diameter bore for accommodation of the cylindrical rotor and a small diameter bore in axial alignment with the large diameter bore, said rotor having an integral shaft supported by a bearing means arranged in the small diameter bore and projecting from the housing, said star pinions being arranged on opposite sides of the cylindrical rotor and each having a shaft supported at only one end in a bore formed in the housing, said housing being arranged to completely enclose the cylindrical rotor and the star pinions, a cover means removably affixed to the housing at the open end for enclosure of the housing interior, a gaseous medium inlet formed in the housing in the region of the rotor shaft bearing means, said housing being formed with passageways for receipt of gaseous medium compressed by inter-action of the rotor and the star pinions, and gaseous medium outlets formed in the cover and connecting with said passageways.

2. An air compressor according to claim 1, wherein at least one oil injection opening is formed in the housing for supply of oil to the rotor for sealing and lubricating purposes.

3. An air compressor according to claim 2, wherein removable cover means are provided on opposite sides of the housing to enclose the ends of each star pinion shaft.

4. An air compressor according to claim 3, wherein a spring loaded seal assembly is positioned upon the rotor shaft adjacent the shaft bearing means, and a bonnet surrounds the seal assembly, said bonnet being formed to receive and maintain lubricant for lubrication of said shaft bearing means, located at the inlet end of the compressor.

* * * * *